United States Patent [19]

Grzeskowiak et al.

[11] Patent Number: 4,828,962

[45] Date of Patent: May 9, 1989

[54] HIGH CONTRAST SCANNER PHOTOGRAPHIC ELEMENTS EMPLOYING RUTHENIUM AND IRIDIUM DOPANTS

[75] Inventors: Nicholas E. Grzeskowiak, Harlow; Keith A. Penfound, Saffron Walden, both of United Kingdom

[73] Assignee: Minnesota Mining and Manufacturing Company, St. Paul, Minn.

[21] Appl. No.: 93,918

[22] Filed: Sep. 8, 1987

[30] Foreign Application Priority Data

Oct. 15, 1986 [GB] United Kingdom ..... 8624704

[51] Int. Cl.[4] ..... G03C 1/06

[52] U.S. Cl. ..... 430/230; 430/607; 430/608; 430/612; 430/569; 430/604; 430/605; 430/584; 430/570; 430/592; 430/447

[58] Field of Search ..... 430/607, 608, 612, 569, 430/230, 604, 605, 584, 570, 447, 592

[56] References Cited

U.S. PATENT DOCUMENTS

| | | | |
|---|---|---|---|
| 3,790,390 | 2/1971 | Shiba et al. | 430/592 |
| 3,901,713 | 8/1975 | Yamasue et al. | 430/569 |
| 4,288,535 | 9/1981 | Kanisawa et al. | 430/569 |

FOREIGN PATENT DOCUMENTS

| | | |
|---|---|---|
| 602158 | 5/1948 | United Kingdom . |
| 1015656 | 1/1966 | United Kingdom . |
| 1057938 | 2/1967 | United Kingdom . |
| 1306801 | 2/1973 | United Kingdom . |
| 1330699 | 9/1973 | United Kingdom . |
| 1351309 | 4/1974 | United Kingdom . |
| 1367700 | 9/1974 | United Kingdom . |

OTHER PUBLICATIONS

Research Disclosure 10801, Apr. 1973.

*Primary Examiner*—Won H. Louie

*Attorney, Agent, or Firm*—Donald M. Sell; Walter N. Kirn; Mark A. Litman

[57] ABSTRACT

Photographic elements comprising a negative working silver halide emulsion containing high intensity reciprocity failure reducing amounts of dopant comprising both ruthenium and iridium ions.

26 Claims, 1 Drawing Sheet

Figure 1:
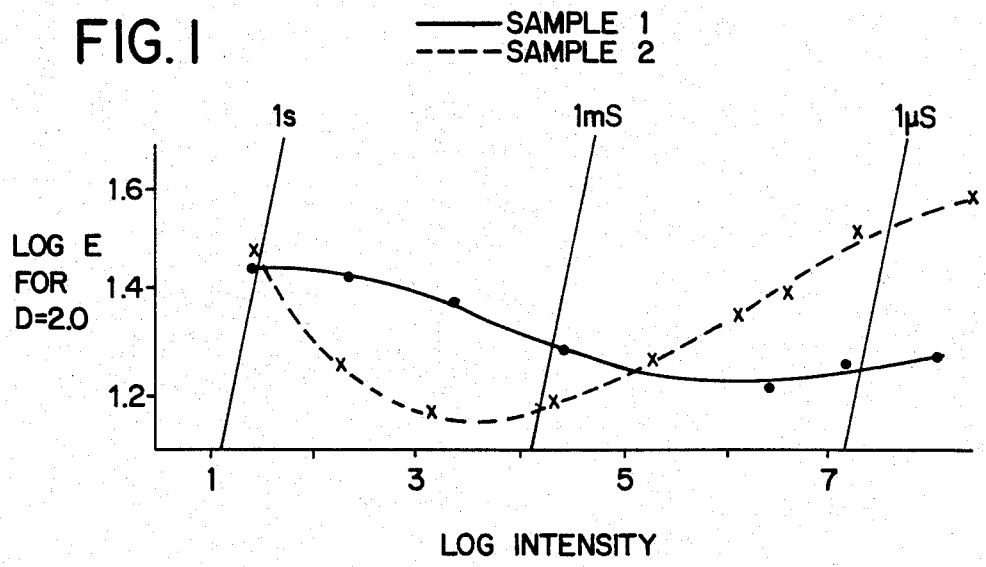

HIGH CONTRAST SCANNER PHOTOGRAPHIC ELEMENTS EMPLOYING RUTHENIUM AND IRIDIUM DOPANTS

FIELD OF INVENTION

This invention relates to photographic elements and in particular to high contrast photographic elements capable of exposure by scanned high intensity sources.

BACKGROUND TO THE INVENTION

There has been a significant increase in the use of electronic scanners for the preparation of half-tone colour separations from continuous tone colour originals. These electronically-modulated high resolution raster scanners scan the photographic element with a very small spot of high intensity light emitted by various lasers, such as (1) a gas laser, e.g. argon ion at 488 nm, helium-neon at 633 nm or helium-cadmium at 442 nm, (2) a near infrared laser diode emitting in the range 750–1500 nm or (3) a light-emitting diode (LED) emitting in either the visible or the near infrared. The exposing spot of light is scanned rapidly across the photo-sensitive material so that the dwell time on any part of the film is typically from $10^{-7}$ to $10^{-6}$ seconds.

The half-tone pattern is produced by means of electronic dot generation (EDG), whereby a number of image pixels produced by the exposure are combined to form the half-tone dot of the required size. Satisfactory dots can be obtained using medium to high contrast materials processed with rapid access chemistry and it is found unnecessary to use the ultra-high contrast "lith" systems which are essential when dots are produced by the traditional optical screening methods.

The contrast requirements for a rapid access processed material can be fulfilled with a silver halide emulsion of narrow grain size distribution containing a contrast enhancing metal dopant, typically, a Group VIII metal complex.

One problem associated with electronic scanners is the need to image the film with a microsecond or sub-microsecond exposure time. Silver halide photographic materials usually respond optimally to exposure times in the range of 1 to 100 milliseconds, and tend to perform less efficiently under microsecond exposures, showing significant losses in both sensitivity and contrast. This is due to the phenomenon of high intensity reciprocity failure (HIRF). In addition to the reduction of sensitivity and contrast, HIRF can also account for a number of related problems, e.g.:

(1) intermittency effects, which cause multiple superimposed short exposures to have a progressively greater effect as the time interval separating them increases from microseconds, to milliseconds or longer;

(2) latent image progression, whereby the latent image gives a stronger developed image, when the interval between exposure and development is of the order of up to one hour;

(3) unusually high sensitivity to developer conditions, e.g. state of exhaustion of the developer.

It is desirable for a scanner material to have a HIRF response that has been reduced to a low level, or preferably eliminated completely, so that the photographic response is independent of the exposure duration.

The use of Group VIII metals as dopants in photographic silver halide emulsions has been known for many years. The dopants are most advantageously added during the crystal growth stages of emulsion preparation, i.e. during initial precipitation and/or physical ripening of the silver halide crystals. Incorporation of these metal dopants into normal, negative-acting photographic emulsions can produce a number of different photographic effects depending on the nature of the metal dopant. Thus, the Group VIII metal complexes are not all equivalent as far as their effect on photographic silver halide emulsion is concerned.

For example, the incorporation of certain Group VIII metal salts results in an enhancement of contrast together with an overall desensitisation. Rhodium salts have found the greatest utility in this respect, as disclosed, for example, in British Patent Specification No. 775 197 using rhodium trichloride, and British Patent No. 1,535,016 using sodium hexachlororhodate. Similar effects have been produced by incorporation of ruthenium, palladium, osmium and platinum as reported by J. W. Mitchell (Photog. Sci. and Eng. 27 (2) p 81 1983) and Research Disclosure 13452 June 1975.

However, quite different effects are obtained with the incorporation of iridium salts. Improvements in sensitivity to high intensity exposure and the reduction in desensitisation caused by mechanical stress have been reported for iridium doped photographic silver halide emulsions in British Patent Specification Nos. 1 527 435 and 1 410 488 and U.S. Pat. Nos. 4,126,472 and 3,847,621.

Certain advantages have been reported for specific combinations of metal ions, for example, British Patent Specification No. 1 395 923 discloses that a mixture of rhodium and iridium complexes provides high contrast to photographic silver halide emulsions whilst avoiding post-exposure latent image intensification. U.S. Pat. No. 3,790,390 discloses this mixture in combination with certain sensitising dyes providing increased sensitivity to microsecond exposure.

U.S. Pat. Nos. 2,448,060, 3,703,584, 3,980,154, 4,147,542 and 4,173,483 disclose photographic silver halide emulsions containing at least one compound containing a metal belonging to Group VIII of the Periodic Table. However, whilst these patents disclose some examples employing the combination of two compounds of different Group VIII metals, e.g. iridium and rhodium there is no exemplification of the combination of iridium and ruthenium compounds.

It has been found that the combination of particular iridium and ruthenium dopants in photographic silver halide emulsions provides surprising and particularly advantageous properties.

SUMMARY OF THE INVENTION

According to the invention, there is provided a photographic element comprising a negative working silver halide emulsion containing high intensity reciprocity failure reducing amounts of dopant, characterised in that the dopant comprises both ruthenium and iridium ions.

In one aspect of the invention the photographic element comprises a negative working silver halide emulsion, the silver halide grains having been formed in the presence of one or more compounds of ruthenium with ruthenium in the +3 or +4 oxidation state having at least three halogen ligands complexed to ruthenium and one or more compounds of iridium with iridium in the +3 or +4 oxidation state having at least three halogen ligands complexed to iridium.

The present invention relies on the combination of particular ruthenium and iridium dopants in a silver halide emulsion to produce a sensitive material that maintains its optimum sensitivity and contrast even at microsecond and sub-microsecond exposure times. The incorporation of the ruthenium compound and the iridium compound produces a silver halide material that exhibits high contrast under exposures of all durations, from 1 second to less than 1 microsecond, with no high intensity reciprocity failure, and therefore well suited for use as an EDG scanner film. In comparison, if a ruthenium compound, is used alone, without the addition of an iridium compound, high contrast is obtained only at exposure times of between 1 and 10 milliseconds and a very strong HIRF effect causes this contrast to fall to a low value at 1 microsecond, so that the material is unsuitable for use as a scanner film. The advantageous properties obtained using the combinement of ruthenium and iridium compounds could not be predicted from the known properties of an iridium compound alone or in combination with other Group VIII metal compounds. Whilst the combination of rhodium and iridium compounds provides silver halide emulsions of good sensitivity and contrast over a range of exposures, the use of a rhodium compound alone does not provide silver halide emulsions which suffer from such severe loss of contrast and sensitivity due to HIRF as found with ruthenium. Thus, unexpectedly, a synergism between the particular ruthenium and iridium compound used in the invention appears to occur.

The invention is applicable to a broad variety of photographic materials, which are required to be scanner compatible. Different shapes and compositions of silver halide grains, types of chemical sensitisation, spectral sensitisation to any wavelength, types of photographic construction giving, for example black developed silver images or single- or multi-layer colour images by colour development, dye bleach or dye release, and different methods of image retention e.g. conventional non-diffusive dyes or silver images or diffusion transfer of dyes, or migration of silver to physical development nuclei, are widely reported in the photographic art and may be employed in the practice of the invention.

The photographic emulsions as used in the present invention may comprise of any of the conventional silver halides e.g. silver chloride, silver bromide, silver chlorobromide, silver iodobromide, silver chloroiodobromide etc. Emulsions containing at least 30 mol/% silver chloride are preferable, with emulsions containing at least 60% chloride being most preferred. Preferably the emulsions are silver chlorobromide emulsions. The silver salts may be in the form of coarse grains or fine grains in the cubic crystal system or octahedral crystal system or a crystal system that is a mixture of the two, or they may be of some other crystal system. Examples of suitable silver halide emulsion types and photographic constructions are described in Research Disclosure 17643, December 1978.

The invention is also applicable to tabular grain emulsions, e.g. as disclosed in Research Disclosure 22534, January 1983, and references cited therein, but excluding the part of this disclosure relating to direct reversal emulsions. The emulsions of this invention may also be spectrally sensitised to infrared radiation as described in U.S. Pat. No. 4,515,888, and references cited therein.

The invention is also applicable to photothermographic emulsions e.g. dry silver emulsions having preformed silver halide grains.

The photographic emulsions are generally formed by precipitation by conventional methods, e.g. by the single jet method or by the double jet method. The emulsions may be of uniform grain shape and grain size, may have a wide range of grain size distribution, or may comprise a mixture of emulsions of two or more kinds. Methods for the preparation of silver halide emulsions are disclosed for example in C. E. K. Mees "The Theory of the Photographic Process", 1966, 3rd edition, p. 31–44, MacMillan Co., New York; P. Glafkides "Chimie Photographique", 1967, 2nd edition, p. 251–308; Photocinema Paul Montel, Paris etc.

Suitable iridium compounds for use in the invention are those in which iridium is in the +3 or +4 oxidation state having at least 3 halogen ligands complexed to the iridium. Preferably the remainder of the coordination sites comprise halogen or water. Preferred halogen ligands are chlorine or bromine. Examples of suitable iridium compounds include iridium (III) chloride $IrCl_3$; iridium (IV) chloride $IrCl_4$; iridium (III) bromide $IrBr_34H_2O$; iridium (IV) bromide $IrBr_4$; potassium hexachloroiridate (III) $K_3IrCl_6$; and potassium hexachloroiridate (IV) $K_2IrCl_6$.

The iridium compounds are incorporated, preferably in the form of aqueous solution, into silver halide emulsions at the time of forming silver halide particles or at the stage of physical ripening. Most preferably the iridium compounds are incorporated at the time of silver halide particle formation, conveniently as an additive to the halide feedstock, or as an independent simultaneous addition to the reaction vessel.

Suitable ruthenium compounds for use in the invention are those in which ruthenium is in the +3 or +4 oxidation state having at least 3 halogen ligands complexed to the ruthenium. Preferably the remainder of the coordination sites comprise halogen or water. Preferred halogen ligands are chlorine or bromine. Examples of ruthenium compounds include ruthenium (III) chloride $RuCl_3$; potassium hexachlororuthenate (IV) $K_2RuCl_6$; potassium pentachloroaquoruthenate (III) $K_2RuCl_5(H_2O)$. The preferred ruthenium complex is $K_2RuCl_5(H_2O)$.

The ruthenium compounds are incorporated into the emulsion in a similar manner to the iridium compounds and preferably incorporated during formation of the silver halide particles, conveniently as an additive to the halide feedstock or as an independent simultaneous addition to the reaction vessel.

The iridium and ruthenium compounds are generally incorporated into the emulsions in individual amounts in each dopant per mole of silver. The exact amount of each dopant will vary depending upon the particular compound, the other dopant and the size and type of silver halide grains present. The molar ratio of ruthenium compound to iridium compound may vary widely e.g. over the range 10:1 to 1:10.

The photographic silver halide emulsions may be chemically and spectrally sensitised to any wavelength of the visable or near infrared regions of the spectrum. Examples of dyes suitable for sensitisation purposes include those of the general formula:

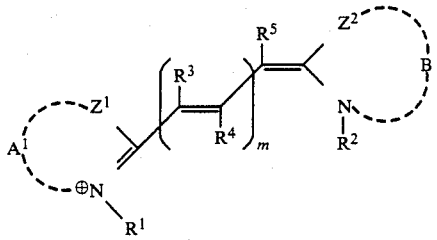

or

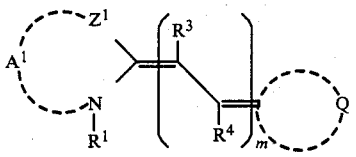

in which:

m is 0 or an integer of 1 to 5;

$R^1$ and $R^2$ are independently selected from aliphatic groups of 1 to 5 carbon atoms, such as alkyl of 1 to 5 carbon atoms, any of which groups may be optionally substituted, $Z^1$ and $Z^2$ are independently selected from O, S, Se, N—$R^1$, and CH.

$A^1$ and B represent the necessary atoms to complete five or six membered heterocyclic rings, which may be optionally fused with aromatic or heteroaromatic rings and may optionally have alkyl, aryl, halogen, oxygen, sulphur, selenium or nitrogen substituents, $R^3$, $R^4$ and $R^5$ are independently H or lower alkyl of up to 4 carbon atoms or optionally when m is greater than or equal to 1 any two of $R^3$, $R^4$ and $R^5$ may together with three adjacent carbon atoms in the polymethine chain of the dye complete a five or six membered carbocyclic ring, which itself may bear substituents, Q represents the components needed to complete an acidic nucleus such as can be derived from barbituric acid, 2-thiobarbituric acid, rhodanine, hydantoin, 2-thio-hydantoin, 4-thiohydantoin, 2-pyrazolin-5-one, 2-isoxazolin-5-one, indan-1,3-dione, cylcohexane- 1,3-dione, 1,3-dioxane-4,6-dione, pyrazolin-3,5-dione, pentane-2,4-dione, alkyl-sulphonylacetonitrile, malononitrile, isoquinolin-4-one, and chroman-2,4-dione.

Particularly preferred sensitising dyes are of the general formula

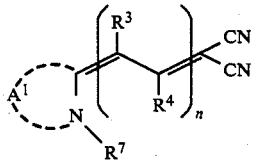

in which:

n is 0, 1 or 2, $R^7$ represents an alkyl group of 1 to 4 carbon atoms, a carboxyalkyl group of 1 to 4 carbon atoms or a sulphoalkyl group of 1 to 4 carbon atoms; and $A^1$, $R^3$ and $R^4$ are as defined above.

Examples of photographic materials in which the invention finds particular utility include colour proofing materials of the type disclosed in our copending British Patent Publication No. 2172118 and European Patent Application Nos. 87303282.5 and 87303280.9. The invention also finds particular utility in emulsions incorporated into lithographic plate constructions of the type disclosed in U.S. Pat. No. 4,461,635. Such printing plates comprise a photolithographic sheet material capable of forming a lithographic printing plate upon imaging via a silver salt diffusion transfer step. The material comprises a substrate e.g. polyester film, a silver halide emulsion layer and an overlaying receptor layer, comprising a high molecular weight hydrophilic polymer and catalytic nuclei for silver salt diffusion transfer development. This material may additionally contain an antihalation layer. When an imagewise exposed plate is contacted with the development solution, the exposed silver halide grains are reduced to silver metal as in conventional development. The unexposed grains dissolve in the developer via formation of soluble silver complexes, such as complexes of silver thiosulphate and diffuse towards the receptor layer. When the soluble silver complexes contact development nuclei contained in the receptor layer, the silver is reduced to a metallic deposit. The deposit can then form the ink receptive image areas of a lithographic printing plate.

The invention will now be illustrated by the following Examples.

EXAMPLE 1

| | | | |
|---|---|---|---|
| Solution A | 75% phthalated gelatin | 28.8 g | 55° C. |
| | water | 228 ml | |
| | 0.1% adenine (in water) | 40 ml | |
| | 2.5M $NH_4Cl$ | 12 ml | |
| Solution B | 2.5M $NH_4Cl$ | 250 ml | 43° C. |
| | 2.5M $NH_4Br$ | 144 ml | |
| | water | 206 ml | |
| Solution C | 2.5M $AgNO_3$ | 400 ml | 43° C. |
| | water | 200 ml | |

Emulsion A—doped with ruthenium and iridium (Invention)

Just prior to precipitation, 4 micromoles of potassium pentachloroaquoruthenate $K_2RuCl_5(H_2O)$, and 1 micromole of potassium hexachloroiridate $K_3IrCl_6$ were added to Solution B. To a well-stirred Solution A, Solutions B and C were added at equal rates of 12 ml/minute, increasing to 19 ml/minute after 8 minutes. The emulsion was coagulated with acid, washed and reconstituted with 70 g of inert bone gelatin.

Emulsion B—doped with ruthenium only (Reference)

The emulsion was prepared in the same manner as Emulsion A, except that the iridium was omitted.

Emulsion C—undoped (Reference)

The emulsion was prepared in the same manner as emulsion A, except that both the dopants were omitted.

Emulsion D—doped with Iridium only (0.5 micromoles/mole Ag) (Reference)

The emulsion was prepared the same as Emulsion A, except that all the ruthenium and half the iridium was omitted, leaving 0.5 micromoles of potassium hexachloroiridate per mole of silver as the only dopant.

Emulsion E—Iridium dopant only (1.0 micromoles/mole Ag) (Reference)

The emulsion was prepared in the same manner as emulsion A, except that the ruthenium dopant was omitted, leaving only the 1.0 micromoles of potassium hexachloroiridate (III) per mole of silver.

The Emulsions A to E were chemically sensitised with sodium thiosulphate and gold chloride, and stabilised with a tetraazaindene stabiliser.

The chemically sensitised Emulsions A to E were spectrally sensitised with 75 ml/mole of a 2% methanolic solution of Dye I.

Dye I

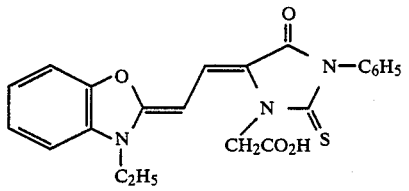

The following precoating additions were made:

Superamide L9C: 0.6 g (a high activity lauric acid—diethanolamine condensate commercially available from Millmaster-Onyx U.K.)

Teepol 610: 0.9 ml (a sodium salt of a secondary alkyl sulphate commercially available from Shell Chemicals UK Limited)

2% formaldehyde: 65 ml

The emulsions were each coated onto a subbed polyester film base, to give a silver coating weight of 4 g/m$^2$. Simultaneously, a solution of 5% gelatin containing:

Superamide L9C: 0.5 g/liter

Teepol 610: 0.75 ml/liter

2% formaldehyde: 22 ml/liter was applied to give a supercoat of 1.3 g/m$^2$ gelatin.

Reciprocity Testing

Reciprocity testing was conducted using an argon ion laser at 488 nm to give a series of static exposures of duration 1.1 seconds, 0.13 seconds, 11 milliseconds and 105 microseconds, and of single scanned exposures of dwell time 105, 21, 7 and 0.2 microseconds. By use of neutral density filters, characteristic D-logE curves were obtained for each of these exposure durations. Speed points derived from these for Emulsions A and B were used to construct the conventional reciprocity plots in FIGS. 1 and 2 of the accompanying drawings showing the total log(exposure) needed to produced a given density (D=2.0) of developed silver against exposing light intensity (and hence, duration). Derived speed and contrast values for Samples made from Emulsions A to E are reported in TABLE 1.

TABLE 1

| | | 488 NM RECIPROCITY RESULTS | | | | | |
|---|---|---|---|---|---|---|---|
| | | RUTHENIUM micromole/ | IRIDIUM micromole/ | LOG(EXPOSURE) FOR D = 2.0 | | CONTRAST D = 0.5 to 2.0 | |
| SAMPLE | EMULSION | mole Ag | mole Ag | AT 10 ms | AT 0.2 microsec | AT 10 ms | AT 0.2 microsec |
| 1 | A (INVENTION) | 4.0 | 1.0 | 1.37 | 1.27 | 4.6 | 4.6 |
| 2 | B (REFERENCE) | 4.0 | — | 1.16 | 1.57 | 4.7 | 2.9 |
| 3 | C (REFERENCE) | — | — | 0.91 | 1.74 | 3.2 | 2.3 |
| 4 | D (REFERENCE) | — | 0.5 | 1.24 | 1.08 | 3.1 | 3.0 |
| 5 | E (REFERENCE) | — | 1.0 | 1.27 | 1.18 | 1.3 | 2.1 |

Figure 2:
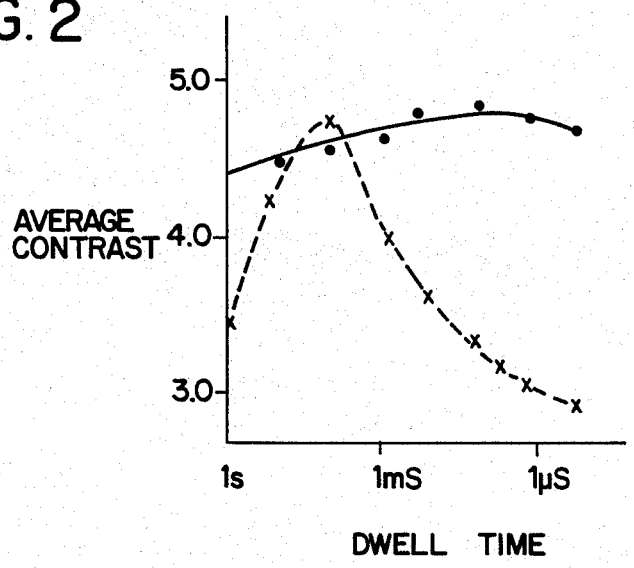

As can be seen from FIGS. 1 and 2, and Table 1 the exposure needed for the mixed ruthenium and iridium doped emulsion of the invention varies little with exposure duration, and the contrast remains at a stable high value thoughout. The reference Emulsion B containing only ruthenium suffers an exceptionally large and rapid loss of contrast at exposure times shorter than the 10 milliseconds optimum duration. Below 10 microseconds the contrast enhancing effect is lost completely.

Reference Emulsion C containing neither ruthenium nor iridium suffers from considerable variation in the required exposure and in contrast as the exposure time changes from milliseconds to microseconds.

Reference Emulsion D showing a normal level of iridium doping causes contrast and exposure to remain approximately constant as the exposure changes from milliseconds to microseconds but does not give the high contrast provided by a ruthenium dopant.

Reference Emulsion E contains the same quantity of iridium as used in Emulsion A, but when used in the absence of ruthenium causes an abnormal depression of contrast at both exposures.

EXAMPLE 2

Silver Chlorobromide emulsions, prepared by a different procedure to that described in Example 1, were used to demonstrate the invention.

A 0.2 micron mean grain size 70/30 chlorobromide emulsion was prepared by a continuous double-jet technique with a high excess chloride concentration to aid Ostwald ripening (changing from 0.14N to 0.07N during the course of the make). The metal dopants were added via the halide solutions throughout the jetting period. Extremely efficient mixing in the emulsion kettle was achieved with a high speed dispersator.

Emulsion F—doped with ruthenium and iridium (Invention)

0.25 micromoles of $K_2RuCl_5(H_2O)$ per mole of silver plus 0.5 micromoles of $K_3IrCl_6$ per mole of silver.

Emulsion G—doped with ruthenium only (Reference)

0.5 micromoles of $K_2RuCl_5(H_2O)$ per mole silver.

Emulsion H—doped with rhodium only (Reference)

0.1 micromoles of sodium hexachlororhodate $Na_3RhCl_6 1.2H_2O$ per mole of silver.

Emulsion I—doped with rhodium and iridium (Reference)

0.1 micromoles of $Na_3RhCl_6 1.2H_2O$ plus 0.5 micromoles of $K_3IrCl_6$ per mole of silver.

The emulsions were chemically sensitised, stabilised, spectrally sensitised with 300 mg of dye

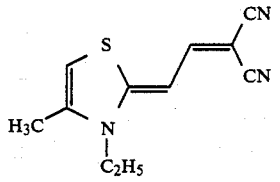

per mole of silver and coated following the procedures of Example 1. The resultant coatings were tested for reciprocity response at 488 nm as described in Example 1 and the results are presented in TABLE 2.

Table 2 shows that the mixed ruthenium and iridium doped emulsion of the invention (Sample 6) varies in sensitivity and contrast only to a small extent between the optimum 10 millisecond duration and the 0.2 micro second duration. However, the emulsion containing ruthenium only (Sample 7) suffers a large change in sensitivity and contrast between these exposure times. These losses in sensitivity and contrast for Sample 7 are far greater than the losses shown by the emulsion containing rhodium only (Sample 8). It is surprising and unexpected that the incorporation of iridium can restore the larger sensitivity and contrast losses associated with the ruthenium only doped emulsion (Sample 7) so that the coating of the invention (Sample 6) has essentially similar characteristics to the coating containing the emulsion doped with iridium and rhodium (Sample 9).

TABLE 2

| SAMPLE | EMULSION | RUTHENIUM micromole/ mole Ag | IRIDIUM micromole/ mole Ag | RHODIUM micromole/ mole Ag | LOG(EXPOSURE) FOR D = 2.0 | | | CONTRAST D = 0.5 to 2.0 | | |
|---|---|---|---|---|---|---|---|---|---|---|
| | | | | | AT 10 ms | AT 0.2 microsec | ΔLOG E(1) | AT 10 ms | AT 0.2 microsec | ΔCON(2) |
| 6 | F (INVENTION) | 0.25 | 0.5 | — | 1.15 | 1.06 | −0.09 | 6.0 | 6.0 | 0 |
| 7 | G (REFERENCE) | 0.5 | — | — | 0.93 | 1.55 | +0.62 | 5.6 | 4.0 | −1.6 |
| 8 | H (REFERENCE) | — | — | 0.1 | 0.91 | 1.27 | +0.36 | 5.2 | 4.3 | −0.9 |
| 9 | I (REFERENCE) | — | 0.5 | 0.1 | 1.21 | 1.14 | −0.07 | 5.2 | 6.0 | +0.8 |

(1)ΔLOG E is the difference in log(exposure) between the 0.2 microseconds and 10 milliseconds values
(2)ΔCON is the difference in contrast between the 0.2 microseconds and 10 milliseconds values

EXAMPLE 3

Application of the invention to a green sensitive Graphic Arts EDG scanner film showing an improvement in latent image stability characteristics.

Cubic 0.2 micron silver chlorobromide emulsions containing 64 molar % silver chloride and 36 molar % silver bromide were prepared by a continuous double-jet technique. The metal dopants were added via the halide solutions throughout the jetting period.

Emulsion J—doped with ruthenium and iridium (invention).

0.29 micromoles of $K_2Ru\ Cl_5\ (H_2O)$ per mole of silver plus 0.24 micromoles of $K_3IrCl_6$ per mole of silver.

Emulsion K—doped with rhodium only (reference).

0.14 micromoles of sodium hexachlororhodate $Na_3RhCl_6.12H_2O$ per mole of silver.

The emulsions were sulphur and gold sensitised, stablilised with a tetrazaindene stabiliser, spectrally sensitised with a conventional green sensitiser, and coated following the procedure of Example 1.

The coated films were exposed on a HELL -350 argon-ion laser scanner and processed through conventional rapid access Graphic Arts processing chemistry at various intervals after exposure. The maximum density (Dmax) of each of the processed film samples was determined and used as a criterion for latent image stability. The results are reported in TABLE 3.

Table 3 shows that the mixed ruthenium and iridium doped emulsion of the invention (Sample 10) changes by only 0.22 Dmax with time compared to the rhodium only reference emulsion (Sample 11) which shows a 0.77 Dmax change. This demonstrates the superior latent image stability characteristics of the invention in a practical scanner application.

TABLE 3

| SAMPLE | EMULSION | RUTHENIUM micromole/ mole Ag | IRIDIUM micromole/ mole Ag | RHODIUM micromole/ mole Ag | D MAX TIME BETWEEN EXPOSURE AND PROCESSING | | | |
|---|---|---|---|---|---|---|---|---|
| | | | | | 1 MIN | 11 MIN | 21 MIN | 31 MIN |
| 10 | J (INVENTION) | 0.24 | 0.29 | — | 4.79 | 4.75 | 4.72 | 4.57 |
| 11 | K (REFERENCE) | — | — | 0.14 | 4.42 | 4.87 | 5.00 | 5.15 |

EXAMPLE 4

Application in a photolithographic sheet capable of forming a lithographic printing plate upon imaging via a silver salt diffusion transfer step.

The lithographic plate construction which is in accordance with U.S. Pat. No. 4,361,635 was prepared as follows:

Anti-halation layer

A 4 mil (100 micron) thick polyester film having a photographic subbing on one side to increase adhesion of the photographic layers to the base was coated with a conventional anti-halation layer consisting of gelatin, silica of 5 micron average grain diameter carbon black an anionic surface active agent, hydroquinone and formaldehyde, as hardener. This composition was coated at a wet coating weight of about 40 milligrams per square meter.

Photographic Emulsion Layer

Conventional negative acting cubic monodisperse silver chlorobromide photographic emulsions containing 75 molar % silver chloride and 25 molar % silver bromide with an average grain size of 0.35 micron were prepared by double jetting the silver and halide solutions under controlled conditions. The metal dopants were added via the halide solutions throughout the jetting period.

Emulsion L—doped with ruthenium and iridium (invention).

0.26 micromoles of $K_2Ru\ Cl_5\ (H_2O)$ per mole of silver plus 0.4 micromoles of $K_3IrCl_6$ per mole of silver.

Emulsion M—doped with rhodium only (reference).

0.2 micromoles of sodium hexachlororhodate $Na_3RhCl_6.2H_2O$ per mole of silver.

The emulsions were flocculated, washed and redispersed in gelatin in the normal manner. Sulphur and gold sensitisers were used to chemically sensitise the reconstituted emulsions. A conventional sensitising dye spectrally sensitising the emulsion to the red region of the visible spectrum was added after chemical sensitisation and prior to stabilisation with a tetrazaindene stabiliser. For coating, extra gelatin, a surface active agent and formaldehyde were added to the photographic emulsions and the final solutions coated over the anti halation layer to give a silver coating weight of about 0.5 grams per square meter.

Receptor Layer

A receptor layer comprising colloidal palladium, Triton X-100 (a wetting agent commercially available from the Rohm and Haas Company) and dialdehyde starch was coated over the photographic emulsion layers to give a palladium metal coating weight of about 1.4 milligrams per square meter.

The photolithographic sheets were exposed on a Monotype Lasercomp 108 PICA phototypesetter, with a helium-neon laser imaging source and an effective exposure time of approximately 0.2 microseconds. Further samples of the photolithographic sheets were imaged by a flash exposure of 0.2 milliseconds duration through a 633 nm narrow cut interference filter and a sensitometric wedge. The exposed plates were processed for 30 seconds in a diffusion transfer developer, Itek Positive Plate Developer, commercially available from the Itek Corporation. After development the plates were rinsed in tap water and allowed to dry.

Film sensitivities were assessed for both exposure methods and are reported in TABLE 4.

Table 4 shows that when exposed for 0.2 milliseconds, Samples 12 and 13 are essentially equivalent in sensitivity, whilst for 0.2 microsecond exposures, the sample of the invention (Sample 12) has now more than twice the sensitivity of the reference sample (Sample 13).

TABLE 4

| SAMPLE | EMULSION | RUTHENIUM micromole/ mole Ag | IRIDIUM micromole/ mole Ag | RHODIUM micromole/ mole Ag | SENSITIVITY in log (Exposure) units 0.2 millisecond exposure | 0.2 microsecond exposure |
|---|---|---|---|---|---|---|
| 12 | L (INVENTION) | 0.26 | 0.4 | — | +0.08 | +0.35 |
| 13 | M (REFERENCE) | — | — | 0.2 | 0 | 0 |

EXAMPLE 5

Safelight Tolerance

In this test, samples were prepared as in Example 3. The test consisted of placing each sample under a yellow safelight at 1.5 footcandle intensity for 0, 1, 4, 8, or 12 minutes. The film was then uniformly exposed on the scanner with 40% halftone dots. The safelight time was defined as the maximum time with an increase in dot size of no greater than 1%. For the rhodium emulsion this was 4 minutes; the Ru/Ir emulsion was 8 minutes thus establishing that films containing ruthenium-/iridium instead of rhodium exhibit greater tolerance to safelight.

EXAMPLE 6

Application of the invention to an infra-red sensitised photographic material showing an improvement in latent image stability.

Cubic silver chlorobromide emulsions containing 64 molar % silver chloride and 36 molar % silver bromide were prepared by a continuous double-jet technique. The metal dopants were added via the halide solutions throughout the jetting period.

Emulsion N—doped with ruthenium and iridium (invention)

0.5 micromoles of $K_2RuCl_5\ (H_2O)$ per mole of silver and 0.15 micromoles of $K_3IrCl_6$ per mole of silver.

Emulsion O—doped with rhodium only (reference)

0.15 micromoles of $Na_3RhCl_6 1.2H_2O$ per mole of silver.

Both emulsions were sulphur and gold sensitised, stabilised with a tetrazaindene stabiliser and spectrally sensitised with the infrared sensitising dye:

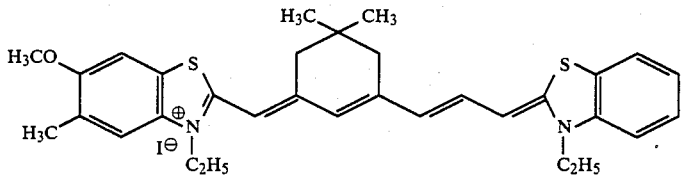

and coated following the procedure of Example 1.

The coated films were exposed for 10 microseconds with a xenon flash lamp filtered to remove UV light. Samples of each coated film were processed as in Example 1 2 minutes after exposure and also 60 minutes after exposure.

The results are reported below in Table 5.

TABLE 5

| SAMPLE | EMULSION | RUTHENIUM micromole/ mole Ag | IRIDIUM micromole/ mole Ag | RHODIUM micromole/ mole Ag | SENSITIVITY in log (Exposure) units Time between exposure and Processing 2 minutes | 60 minutes |
|---|---|---|---|---|---|---|
| 14 | N (INVENTION) | 0.5 | 0.15 | — | 0.10 | 0.12 |
| 15 | O (REFERENCE) | — | — | 0.15 | 0.13 | 0.24 |

The results of Table 5 demonstrate that the mixed ruthenium and iridium doped emulsion of the invention (sample 14) shows only a negligible speed gain of 0.02 log exposure units with increased time lapse between exposure and processing compared to the rhodium doped emulsion (sample 15) which shows a 0.11 log exposure speed gain.

This Example demonstrates the superior latent image stability of an infra-red sensitised emulsion of the invention.

We claim:

1. A photographic element comprising a negative working silver halide emulsion containing high intensity reciprocity failure reducing amounts of dopant, characterised in that the dopant comprises both ruthenium and iridium ions.

2. A photographic element comprising a negative working silver halide emulsion characterised in that the silver halide grains were formed in the presence of one or more compounds of ruthenium with ruthenium in the +3 or +4 oxidation state having at least 3 halogen ligands complexed to ruthenium and one or more compounds of iridium with iridium in +3 or +4 oxidation state having at least 3 halogen ligands complexed to iridium.

3. An element as claimed in claim 2 characterised in that the quantity of ruthenium compound is in the range $10^{-9}$ to $10^{-4}$ molar equivalents of ruthenium compound per mole equivalent of silver and the quantity of iridium compound is in the range $10^{-9}$ to $10^{-4}$ molar equivalents of iridium compound per mole equivalent of silver.

4. An element as claimed in claim 3 characterised in that the quantity of ruthenium compound is in the range $10^{-7}$ to $10^{-5}$ molar equivalents of ruthenium compound per mole equivalent of silver and the quantity of iridium compound is in the range $10^{-7}$ to $10^{-5}$ molar equivalents of iridium compound per mole equivalent of silver.

5. An element as claimed in claim 3 characterised in that the remainder of the coordination sites of the iridium and/or ruthenium compound comprises halogen or water.

6. An element as claimed in claim 3 characterised in that the halogen ligand of the iridium and/or ruthenium compound are selected from chlorine and bromine.

7. An element as claimed in claim 3 characterised in that the iridium compound is $K_3IrCl_6$.

8. An element as claimed in claim 3 characterised in that the ruthenium compound is $K_2RuCl_5(H_2O)$.

9. An element as claimed in claim 3 in which one or both of the compounds of ruthenium and iridium are incorporated into the silver halide crystals during crystal growth or are added to the silver halide crystal during physical ripening.

10. A photographic element as claimed in any preceding claim characterised in that the emulsion is spectrally sensitised with a spectral sensitising dye.

11. A photographic element as claimed in claim 10 characterised in that the sensitising dye has the general formula

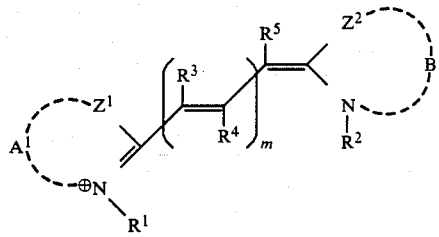

or

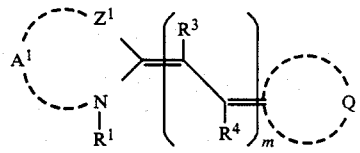

in which:

m is 0 or an integer of 1 to 5;

$R^1$ and $R^2$ are independently selected from aliphatic groups of 1 to 5 carbon atoms which groups may be optionally substituted, $Z^1$ and $Z^2$ are independently selected from O, S, Se, N—$R^1$, and CH.

$A^1$ and B represent the necessary atoms to complete five or six membered heterocyclic rings, which may be optionally fused with aromatic or heteroaromatic rings and may optionally have alkyl, aryl, halogen, oxygen, sulphur, selenium or nitrogen substituents, $R^3$, $R^4$ and $R^5$ are independently H or lower alkyl of up to 4 carbon atoms or optionally when m is greater than or equal to 1 any two of $R^3$, $R^4$ and $R^5$ may together with three adjacent carbon atoms in the polymethine chain of the dye complete a five or six membered carbocyclic ring, which itself may bear substituents, Q represents the components needed to complete an acidic nucleus.

12. A photographic element as claimed in claim 10 characterised in that the sensitising dye has the general formula

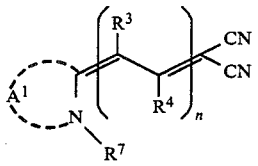

in which:

n is 0, 1 or 2, $R^7$ represents an alkyl group of 1 to 4 carbon atoms, a carboxyalkyl group of 1 to 4 carbon atoms or a sulphoalkyl group of 1 to 4 carbon atoms;

$A^1$ represents the necessary atoms to complete five or six membered heterocyclic rings, which may be optionally fused with aromatic or heteroaromatic rings and may optionally have alkyl, aryl, halogen, oxygen, sulphur, selenium, or nitrogen substituents, and $R^3$ and $R^4$ are indepenently H or lower alkyl of up to 4 carbon atoms or optionally when n is greater than or equal to 1 $R^3$ and $R^4$ may together with three adjacent carbon atoms in the polymethine chain of the dye complete a five or six membered carbocyclic ring, which itself may bear substituents.

13. A photographic element as claimed in claim 3 in which the photographic emulsion is in association with a receptor layer to form a silver salt diffusion transfer system.

14. A method of recording an image which comprises exposing a photographic element as claimed in claim 3 and thereafter processing the element to develop an image.

15. A method as claimed in claim 14 characterised in that the element is exposed for a dwell time of less than 1 ms by a high intensity source selected from a gas laser, a near-infrared laser diode, and a light emitting diode.

16. A method of manufacturing a silver halide emulsion characterised in that at least one or more compounds of ruthenium with ruthenium in the +3 or +4 oxidation state having at least 3 halogen ligands complexed to ruthenium and one or more compounds of iridium with iridium in +3 or +4 oxidation state having at least 3 halogen ligands complexed to iridium are present during the crystal growth stages of the silver halide.

17. A method as claimed in claim 16 characterised in that one or both of the compounds of ruthenium and iridium are present as an additive in the halide feedstock prior to reaction with silver to precipitate silver halide or are added simultaneously with the halide feedstock.

18. A method as claimed in claim 16 characterised in that the quantity of ruthenium compound is in the range $10^{-9}$ to $10^{-4}$ molar equivalents of ruthenium compound per mole equivalent of silver and the quantity of iridium compound is in the range $10^{-8}$ to $10^{-4}$ molar equivalents of iridium compound per mole equivalent of silver.

19. The element of claim 1 wherein said silver halide emulsion is spectrally sensitised to the infrared.

20. The element of claim 2 wherein said silver halide emulsion is spectrally sensitised to the infrared.

21. The element of claim 3 wherein said silver halide emulsion is spectrally sensitised to the infrared.

22. The element of claim 5 wherein said silver halide emulsion is spectrally sensitised to the infrared.

23. The element of claim 6 wherein said silver halide emulsion is spectrally sensitised to the infrared.

24. The element of claim 8 wherein said silver halide emulsion is spectrally sensitised to the infrared.

25. The element of claim 11 wherein said silver halide emulsion is spectrally sensitised to the infrared.

26. The element of claim 12 wherein said silver halide emulsion is spectrally sensitised to the infrared.

* * * * *